US010786028B2

(12) United States Patent
Cech et al.

(10) Patent No.: US 10,786,028 B2
(45) Date of Patent: Sep. 29, 2020

(54) HELMET VENT ADAPTER

(71) Applicant: Trek Bicycle Corporation, Waterloo, WI (US)

(72) Inventors: Michael Cech, Kohler, WI (US); Ivan Luccion, Waterloo, WI (US)

(73) Assignee: Trek Bicycle Corporation, Waterloo, WI (US)

( * ) Notice: Subject to any disclaimer, the term of this patent is extended or adjusted under 35 U.S.C. 154(b) by 404 days.

(21) Appl. No.: 14/715,533

(22) Filed: May 18, 2015

(65) Prior Publication Data

US 2016/0007668 A1 Jan. 14, 2016

Related U.S. Application Data

(60) Provisional application No. 61/994,908, filed on May 18, 2014.

(51) Int. Cl.
*A42B 3/04* (2006.01)

(52) U.S. Cl.
CPC ..... *A42B 3/04* (2013.01)

(58) Field of Classification Search
CPC ..... A42B 3/064; A42B 3/124; A42B 3/065; A42B 3/04; A42B 3/0406; A42B 3/042; A42B 3/044; A42B 3/127; A42B 3/324; A63B 71/10
USPC ... 2/411, 455, 413, 422, 410, 424, 414, 420, 2/425, 452, 429, 13, 15; 411/508; 24/297; 362/570
See application file for complete search history.

(56) References Cited

U.S. PATENT DOCUMENTS 2,306,362 A * 12/1942 Wolff ..... A42B 3/065 2/5
3,999,220 A * 12/1976 Keltner ..... A42B 3/065 2/413
4,024,586 A * 5/1977 Lamb ..... A42B 3/124 2/414
4,134,156 A * 1/1979 Gyory ..... A42B 3/122 2/413
4,307,471 A * 12/1981 Lovell ..... A42B 3/065 2/411
4,744,107 A * 5/1988 Fohl ..... A42B 3/227 2/422
4,995,117 A * 2/1991 Mirage ..... A42B 3/0493 2/410
5,086,520 A * 2/1992 Arai ..... A42B 3/283 2/171.3
5,101,517 A * 4/1992 Douglas ..... A42B 3/20 2/424
5,204,998 A * 4/1993 Liu ..... F16F 1/3732 2/411

(Continued)

*Primary Examiner* — Nathan E Durham
*Assistant Examiner* — Abby M Spatz
(74) *Attorney, Agent, or Firm* — Bell &Manning, LLC; Christopher Kalafut

(57) ABSTRACT

An apparatus comprising a helmet. The helmet can include at least one vent. A vent adapter can be configured to secure into the at least one vent. The vent adapter can include a first attachment surface and a second attachment surface. A mount can be configured to secure into the vent adapter. The mount can include a first attachment portion configured to mate with the first attachment surface. The mount can also include a second attachment portion configured to mate with the second attachment surface.

18 Claims, 14 Drawing Sheets

(56) References Cited

U.S. PATENT DOCUMENTS 6,009,561 A * 1/2000 Bullock ..... A42B 3/227 2/12
6,009,562 A * 1/2000 Bullock ..... A42B 3/16 2/12
6,125,477 A * 10/2000 Crippa ..... A42B 3/222 2/10
6,401,260 B1 * 6/2002 Porth ..... A42B 1/004 2/171
6,616,294 B1 * 9/2003 Henry ..... A42B 3/04 2/422
6,718,559 B1 * 4/2004 Davidson ..... A42B 3/0406 2/209.13
7,607,179 B2 * 10/2009 Shih ..... A42B 3/20 2/411
7,975,320 B2 * 7/2011 Muskovitz ..... A42B 3/283 2/410
8,009,847 B2 * 8/2011 Planansky ..... H04R 5/02 2/422
8,166,575 B2 * 5/2012 Haselmayer ..... A42B 3/166 2/10
8,256,032 B2 * 9/2012 Muskovitz ..... A42B 3/12 2/171.3
8,533,869 B1 * 9/2013 Capuano ..... A42B 3/12 2/171
8,615,817 B2 * 12/2013 Phillips ..... A42B 3/064 2/2.5
8,661,571 B1 * 3/2014 Teetzel ..... A42B 3/04 2/422
8,834,394 B2 * 9/2014 Ghajar ..... A61F 5/055 128/846
8,850,623 B1 * 10/2014 Mazzoccoli ..... A42B 3/121 2/411
9,545,125 B2 * 1/2017 Yoon ..... A41D 13/015
2005/0283885 A1 * 12/2005 Stroud ..... A42B 3/062 2/411
2007/0190293 A1 * 8/2007 Ferrara ..... B29C 45/0053 428/166
2008/0163410 A1 * 7/2008 Udelhofen ..... A42B 3/20 2/413
2009/0288242 A1 * 11/2009 Kato ..... A42B 3/223 2/425
2012/0180199 A1 * 7/2012 Chilson ..... A42B 3/283 2/411
2012/0180200 A1 * 7/2012 Gaudet ..... A42B 3/121 2/411
2012/0222197 A1 * 9/2012 Nagely ..... A42B 3/0473 2/410
2012/0317705 A1 * 12/2012 Lindsay ..... A42B 3/062 2/413
2013/0061371 A1 * 3/2013 Phipps ..... A42B 3/064 2/411
2014/0007322 A1 * 1/2014 Marz ..... A42B 3/065 2/411
2014/0173810 A1 * 6/2014 Suddaby ..... A42B 3/124 2/413
2014/0325744 A1 * 11/2014 Klein ..... A42B 3/20 2/411
2015/0143616 A1 * 5/2015 Steere ..... A42B 3/127 2/414
2015/0164172 A1 * 6/2015 Linares ..... A42B 3/064 2/411

* cited by examiner

HELMET VENT ADAPTER

BACKGROUND

The present invention relates generally to the field of helmets and more particularly to the field of bicycle helmets.

SUMMARY

One illustrative embodiment is related to an apparatus comprising a helmet. The helmet can include at least one vent. A vent adapter can be configured to secure into the at least one vent. The vent adapter can include a first attachment surface and a second attachment surface. A mount can be configured to secure into the vent adapter. The mount can include a first attachment portion configured to mate with the first attachment surface. The mount can also include a second attachment portion configured to mate with the second attachment surface.

BRIEF DESCRIPTION OF THE DRAWINGS

The foregoing and other features of the present disclosure will become more fully apparent from the following description and appended claims, taken in conjunction with the accompanying drawings. Understanding that these drawings depict only several embodiments in accordance with the disclosure and are, therefore, not to be considered limiting of its scope, the disclosure will be described with additional specificity and detail through use of the accompanying drawings.

DETAILED DESCRIPTION OF THE ILLUSTRATIVE EMBODIMENTS

Figure 1:
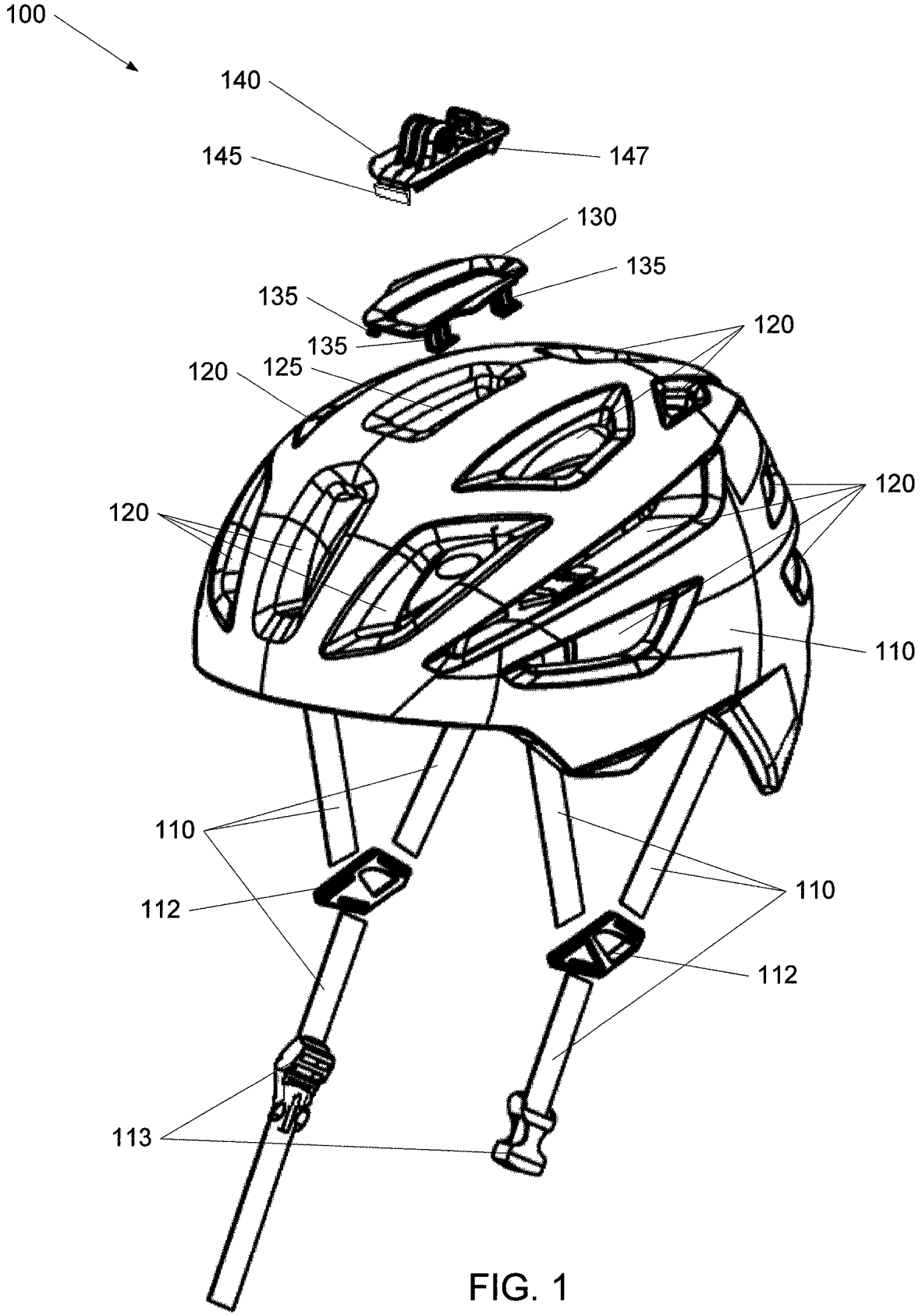
FIG. 1 is an exploded perspective view of a helmet in accordance with an illustrative embodiment.

In the following detailed description, reference is made to the accompanying drawings, which form a part hereof. In the drawings, similar symbols typically identify similar components, unless context dictates otherwise. The illustrative embodiments described in the detailed description, drawings, and claims are not meant to be limiting. Other embodiments may be utilized, and other changes may be made, without departing from the spirit or scope of the subject matter presented here. It will be readily understood that the aspects of the present disclosure, as generally described herein, and illustrated in the figures, can be arranged, substituted, combined, and designed in a wide variety of different configurations, all of which are explicitly contemplated and make part of this disclosure.

The present disclosure is directed to a helmet vent adapter. Referring to FIG. 1, an exploded perspective view of a helmet 100 in accordance with an illustrative embodiment is shown. The helmet 100 can have a helmet shell 110. The helmet shell 110 can enclose, fully or partially, a helmet core (not shown). Straps 111 can be attached to the helmet shell 110, the helmet core, or both. The straps 111 can include strap links 112 and buckle 113.

The helmet shell 110 can be made of, for example, plastic, fiber reinforced plastic, metal or any other material. The fiber can be a carbon fiber. In other embodiments, fibers such as aramid (e.g., Kevlar™), fiberglass, boron fibers, ceramic fibers, nylon, or any other fiber can be used. The fiber can be a combination of fibers. A resin system of the fiber reinforced plastic can be, for example, an epoxy. The resin can be fortified with particulate, nanotubes, fibers, and nanostructures. In one embodiment, the fiber reinforced plastic can be a thermoset. In another embodiment, the fiber reinforced plastic can be a thermoplastic. The helmet shell 110 can include bismaleimide, polyphenylene sulfide, polyetherimide, polyamide, polyetheretherketone, polystyrene, nylon, polypropylene, polyethylene, vinyls, acrylics, and/or polycarbonates.

The helmet core can be made of, for example, a foam such as expanded polystyrene. The helmet core can include, for example, a reinforcement (not shown) embedded in the foam such as a plastic grid or fiber reinforced plastic lacing. The reinforcement can hold the foam together and provide structural rigidity.

The helmet shell 110 can include vents 120 and 125. The vents 120 and 125 can be openings that allow air from an outside of the helmet 100 to and inside of the helmet 100. The vents 120 and 125 can also extend through the helmet core. The vents 120 and 125 can allow air to enter the helmet 100 to cool a user's head.

A vent adapter 130 can be configured to attach to vent 125. In one embodiment, the vent adapter 130 can include attachment devices 135. The attachment devices 135 can include, for example, a wedge shape attached to a body of the vent adapter 130 by a living hinge (i.e., a flexible portion). Thus, when the vent adapter 130 is inserted into the vent 125, the wedges can pass over an outside surface of the vent 125 and can snap behind or into at least one locking surface of the vent 125. The vent adapter 130 can include at least one opening to allow air to enter the helmet 100 to cool a user's head. In one embodiment, the opening is approximately matches the shape and size of the vent 125. The vent adapter 130 can be adapted for any vent on a helmet.

The vent adapter 130 can be made of, for example, plastic, fiber reinforced plastic, metal or any other material. The fiber can be a carbon fiber. In other embodiments, fibers such as aramid (e.g., Kevlar™), fiberglass, boron fibers, ceramic fibers, nylon, or any other fiber can be used. The fiber can be a combination of fibers. A resin system of the fiber reinforced plastic can be, for example, an epoxy. The resin can be fortified with particulate, nanotubes, fibers, and nanostructures. In one embodiment, the fiber reinforced plastic can be a thermoset. In another embodiment, the fiber reinforced plastic can be a thermoplastic. The vent adapter 130 can include bismaleimide, polyphenylene sulfide, polyetherimide, polyamide, polyetheretherketone, polystyrene, nylon, polypropylene, polyethylene, vinyls, acrylics, and/or polycarbonates.

A mount clip 140 can be configured to attach to vent adapter 130. In one embodiment, the mount clip 140 can include an attachment device 145 and a release mechanism 147. The attachment device 145 can include, for example, a wedge shape attached to a body of the mount clip 140 by a living hinge (i.e., a flexible portion). The release mechanism 147 can include, for example, a wedge shape configured to spring into a locking portion or behind a ledge and to swing out of the locking portion or past the ledge. Thus, when the mount clip 140 is inserted into the vent adapter 130, the wedges can pass over an outside surface of the vent adapter 130 and can snap behind or into at least one locking surface of the vent adapter 130. In on embodiment, the mount clip 140 can include at least one opening to allow air to enter the helmet 100 to cool a user's head. In one embodiment, the base of the mount clip 140 approximately matches the shape and size of an opening of the vent adapter 130. The mount clip 140 can be adapted for any vent adapter on a helmet.

The mount clip 140 can be made of, for example, plastic, fiber reinforced plastic, metal or any other material. The fiber can be a carbon fiber. In other embodiments, fibers such as aramid (e.g., Kevlar™), fiberglass, boron fibers, ceramic fibers, nylon, or any other fiber can be used. The fiber can be a combination of fibers. A resin system of the fiber reinforced plastic can be, for example, an epoxy. The resin can be fortified with particulate, nanotubes, fibers, and nanostructures. In one embodiment, the fiber reinforced plastic can be a thermoset. In another embodiment, the fiber reinforced plastic can be a thermoplastic. The mount clip 140 can include bismaleimide, polyphenylene sulfide, polyetherimide, polyamide, polyetheretherketone, polystyrene, nylon, polypropylene, polyethylene, vinyls, acrylics, and/or polycarbonates.

In an alternative embodiment, the mount clip 140 can clip directly into the vent 125. In another alternative embodiment, the helmet shell 110 is not required and the vent adapter 130 can clip directly into the helmet core or to a reinforcement of the helmet core. In another alternative embodiment, the helmet shell 110 is not required and the mount clip 140 can clip directly into the helmet core or to a reinforcement of the helmet core.

Advantageously, the vent adapter 130 can provide a secure means of attaching a mount clip while preserving ventilation. Advantageously, a mount clip configured to clip directly into a vent reduces the complexity of attaching a camera to a helmet.

Figure 2:
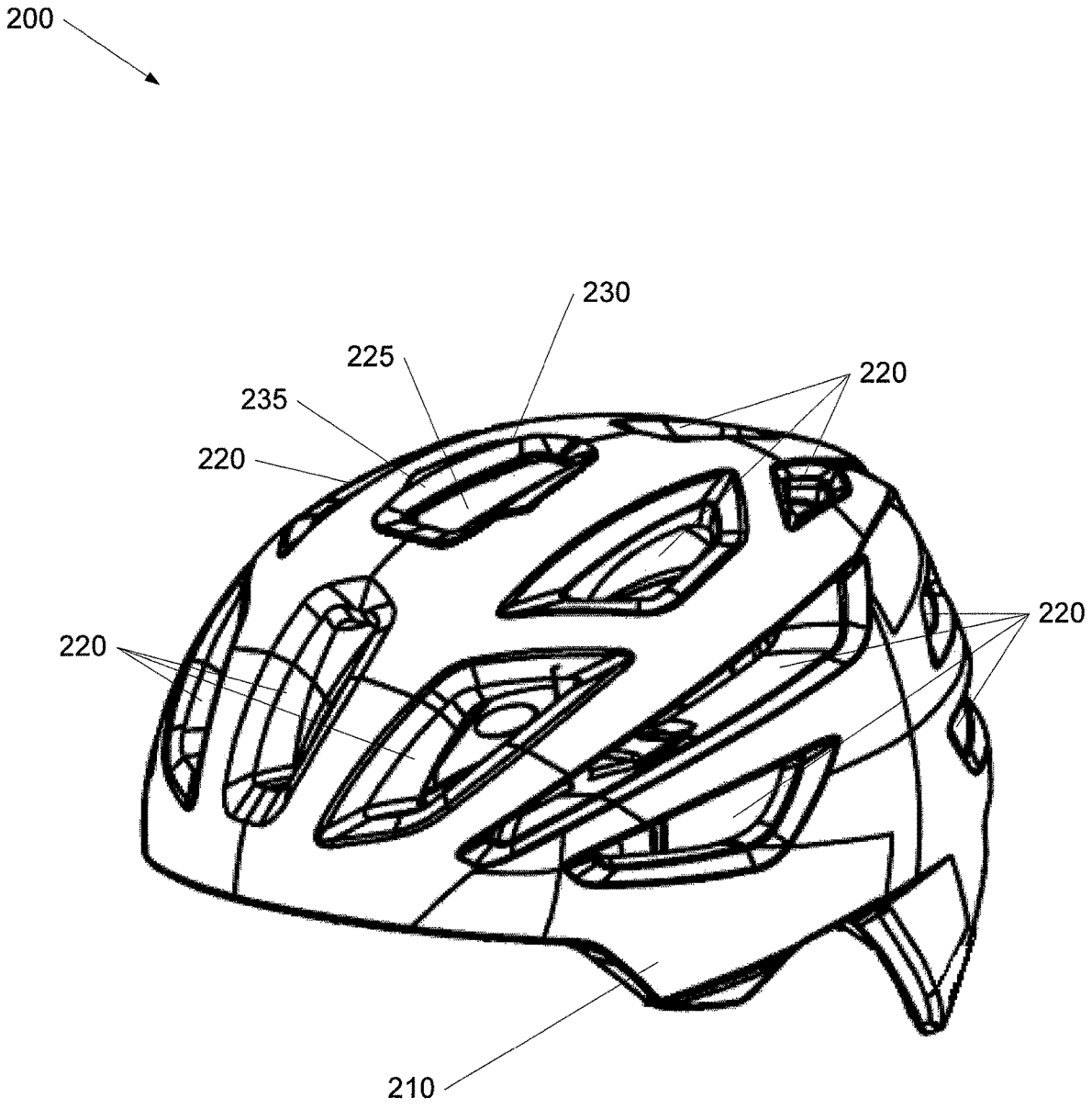
FIG. 2 is a perspective view of a helmet with vent adapter installed in accordance with an illustrative embodiment.

Referring now to FIG. 2, a perspective view of a helmet 200 with vent adapter 230 installed in accordance with an illustrative embodiment is shown. The helmet 200 can have a helmet shell 210. The helmet shell 210 can enclose, fully or partially, a helmet core (not shown).

The helmet shell 210 can include vents 220 and 225. The vents 220 and 225 can be openings that allow air from an outside of the helmet 200 to and inside of the helmet 200. The vents 220 and 225 can also extend through the helmet core. The vents 220 and 225 can allow air to enter the helmet 200 to cool a user's head.

A vent adapter 230 can be installed (clip into) into vent 225 via attachment devices (not shown). The vent adapter 230 can include at least one opening to allow air to enter the helmet 200 to cool a user's head. The vent adapter 230 can be adapted for any vent on a helmet. An exposed surface 235 of the vent adapter 230 can be configured to blend into the shape of the helmet shell 210, thereby minimizing protrusions. Thus, a user can choose to not install or remove a mount clip so that the helmet 200 substantially retains its looks and ventilation characteristics.

Figure 3:
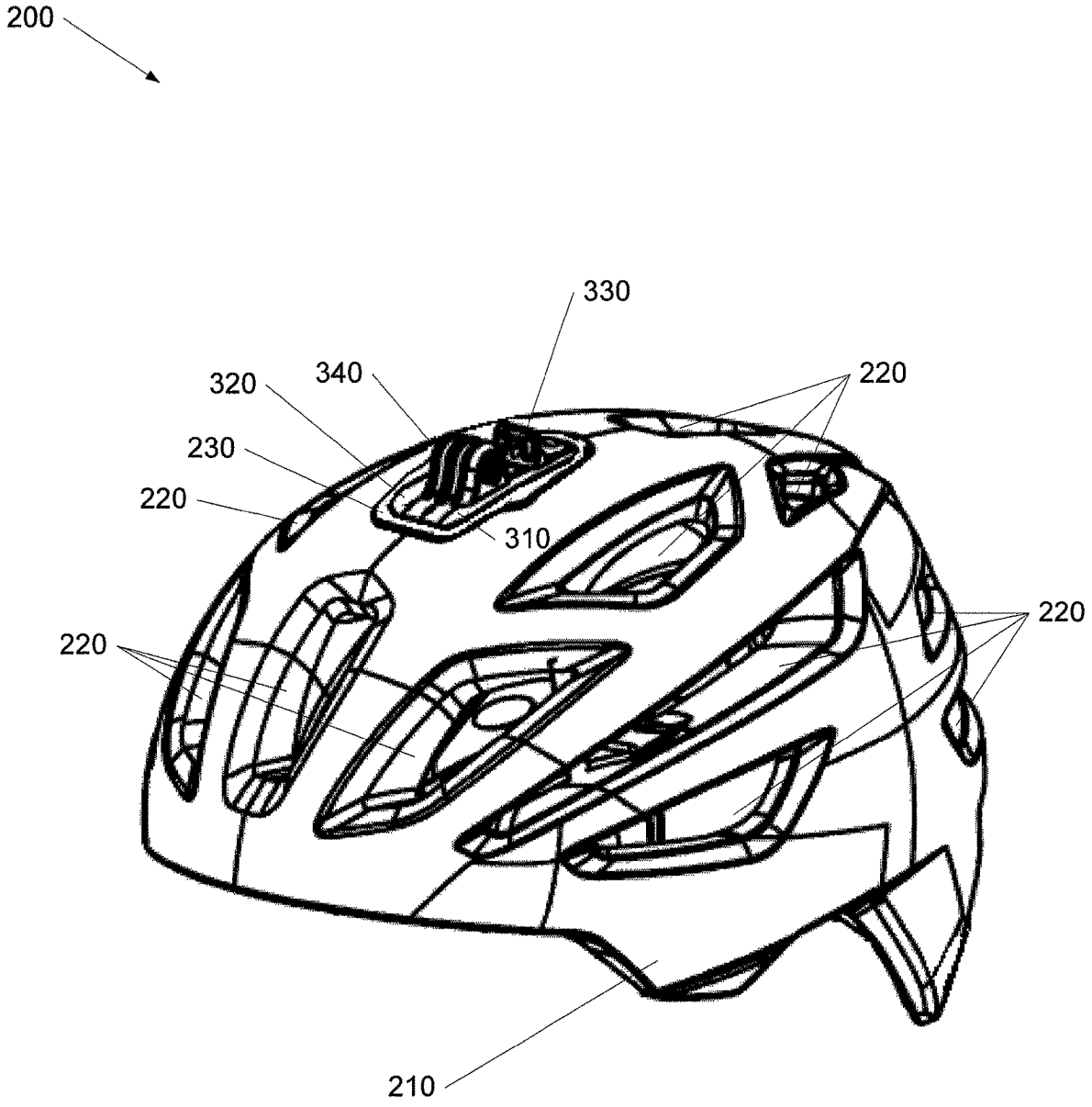
FIG. 3 is a perspective view of the helmet with vent adapter of FIG. 2 also with mount clip 310 installed in accordance with an illustrative embodiment.

Referring now to FIG. 3, a perspective view of the helmet 200 with vent adapter 230 of FIG. 2 also with mount clip 310 installed in accordance with an illustrative embodiment is shown. As discussed above, the helmet 200 can have a helmet shell 210. The helmet shell 210 can include vents 220 and 225. A vent adapter 230 can be installed (clip into) into vent 225 via attachment devices (not shown).

A mount clip 310 can be installed (clip into) into vent adapter 230 via attachment devices (not shown). An exposed surface 330 of the mount clip 310 can be configured to blend into the shape of the vent adapter 230 and the helmet shell 210, thereby minimizing protrusions. The mount clip 310 can include a release mechanism for detaching the mount clip 310 from the vent adapter 230. The mount clip 310 can include a mounting point 340 for attaching devices such as mount adapters, cameras, lights, etc.

Figure 4:
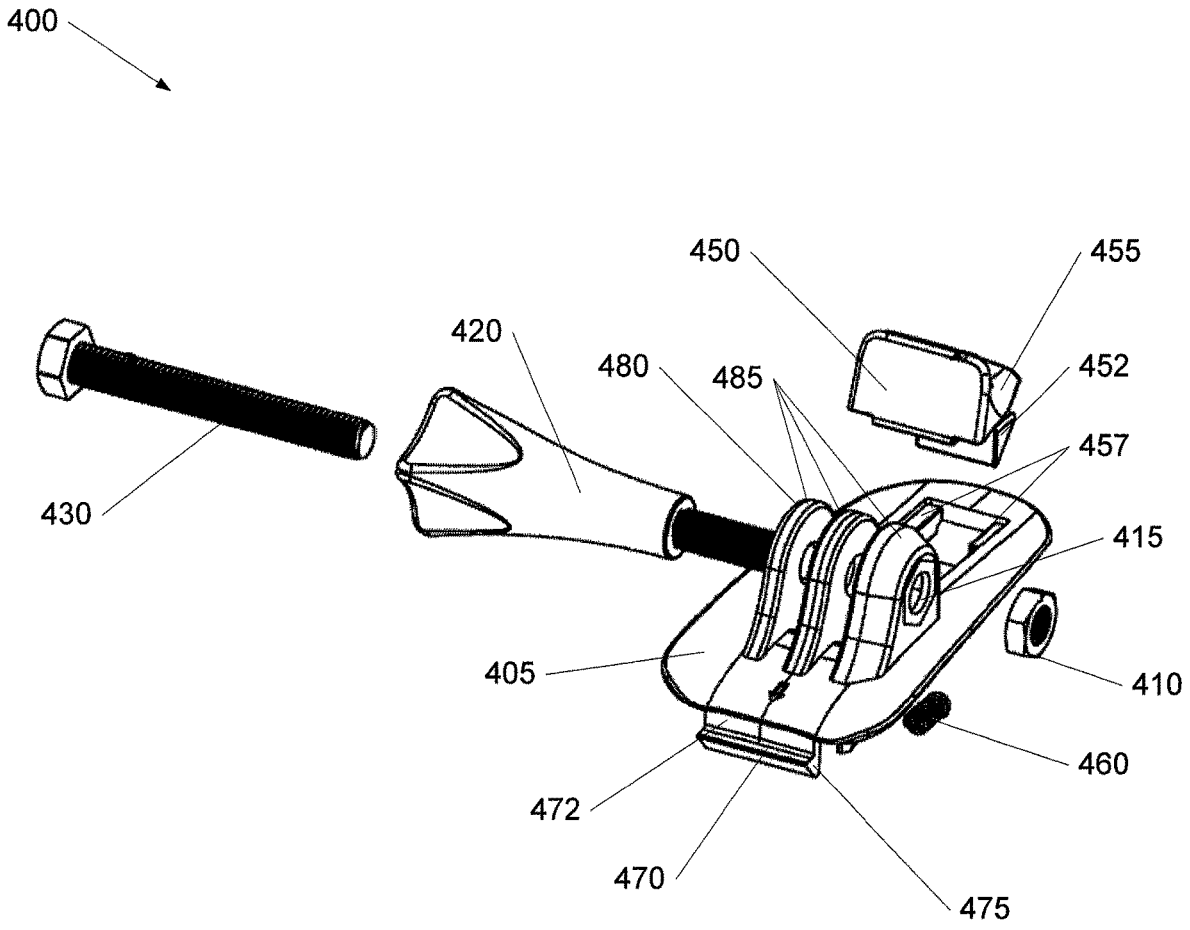
FIG. 4 is an exploded perspective view of a mount clip assembly in accordance with an illustrative embodiment.

Referring now to FIG. 4, an exploded perspective view of a mount clip assembly 400 in accordance with an illustrative embodiment is shown. The mount clip assembly 400 can include a mount base 405. The mount base 405 can include a mounting point 480, a first attachment device 470 and a sliding mount 457 for a second attachment device 450. The mount base 405 can be configured to match or blend into a surrounding vent adapter and/or helmet shell.

The mounting point 480 can include fingers 485. One of the fingers 485 can be configured to retain a nut 410. The fingers 485 can include openings 415 to accept a bolt 430 that can thread into the nut 410. The bolt 430 can be manipulated using a knob 420. When the knob 420 is tightened, the fingers 485 can be drawn together between the knob 420 and the nut 410.

The first attachment device 470 can include a living hinge 472 and a wedge clip 475. The second attachment device 450 can include a wedge clip 452. A spring 460 can be captured between the second attachment device 450 and the mount base 405. The second attachment device 450 can be attached to the sliding mount 457 such that pressing on a manipulation surface 455 of the second attachment device 450 will slide the wedge clip 452 away from and past its corresponding clipping surface.

Figure 5:
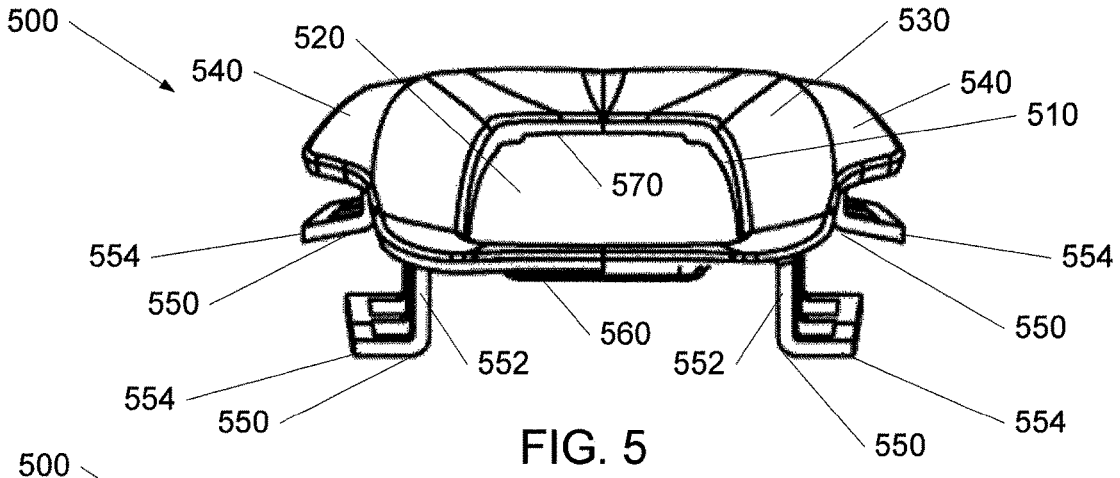
FIG. 5 is a front view of a vent adapter in accordance with an illustrative embodiment.
Figure 6:
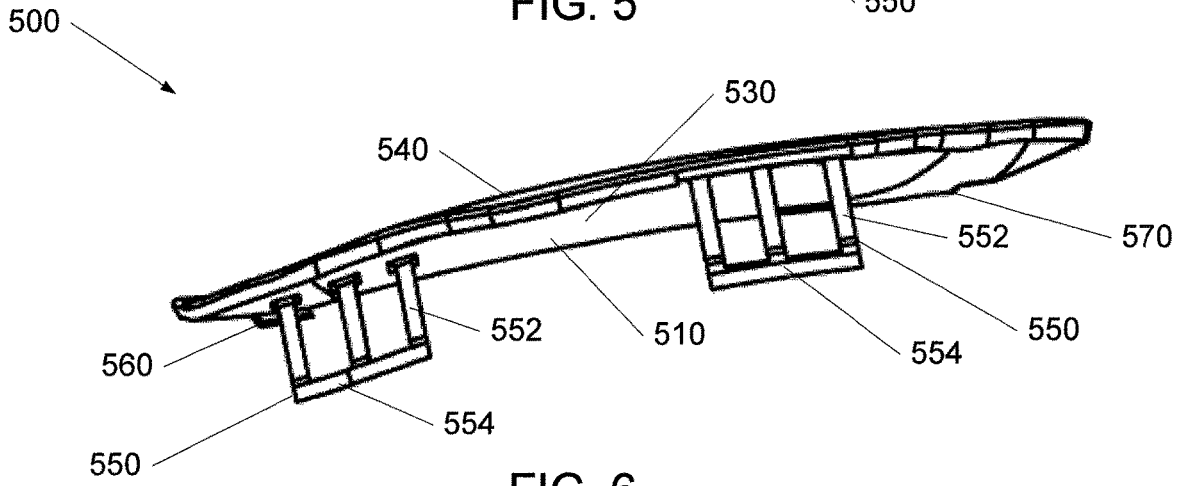
FIG. 6 is a side view of the vent adapter of FIG. 5 in accordance with an illustrative embodiment.
Figure 7:
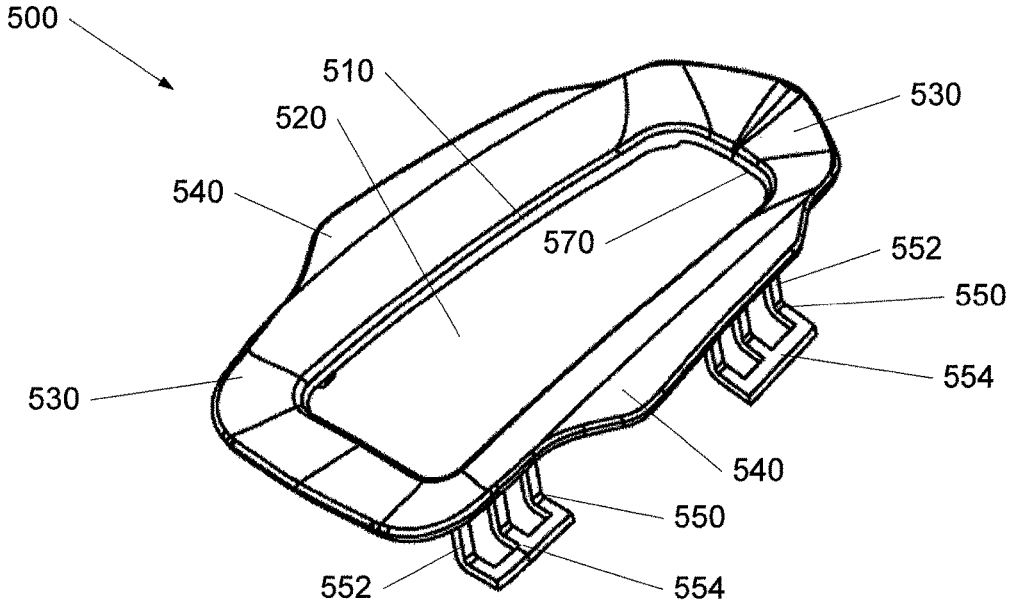
FIG. 7 is a perspective view of the vent adapter of FIG. 5 in accordance with an illustrative embodiment.
Figure 8:
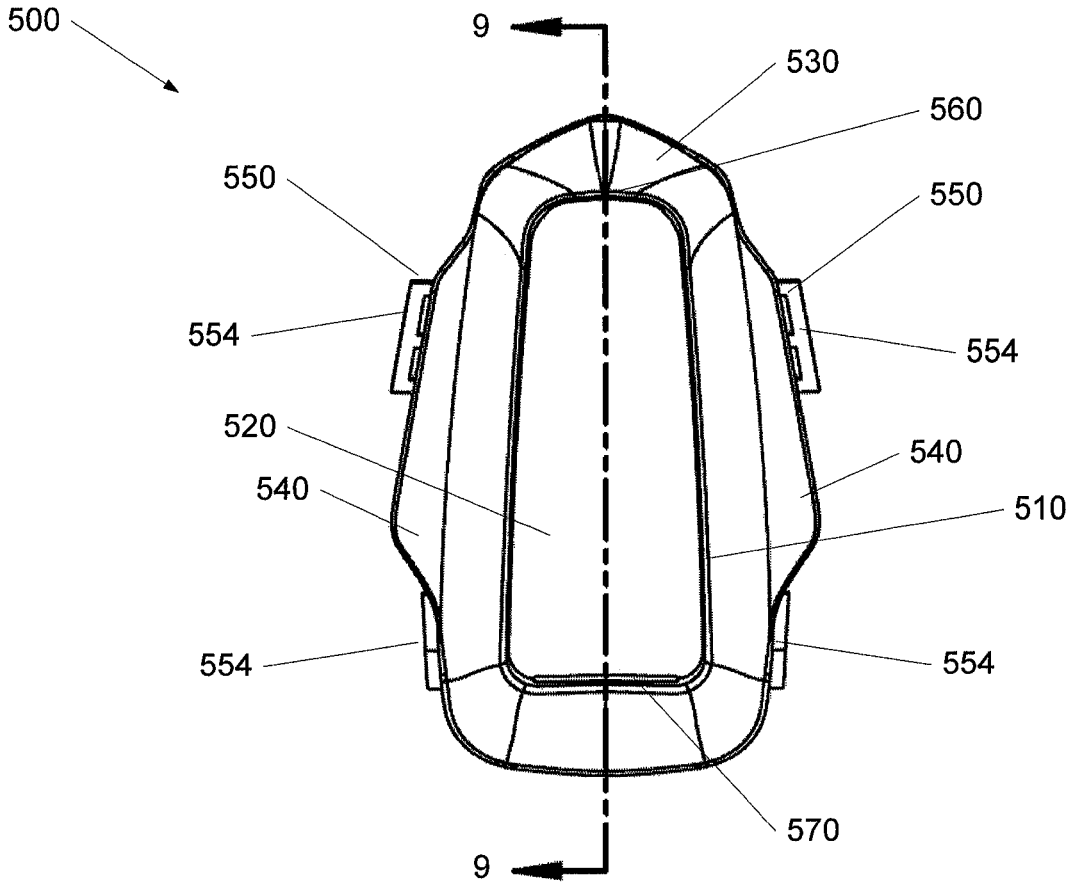
FIG. 8 is a top view of the vent adapter of FIG. 5 in accordance with an illustrative embodiment.
Figure 9:
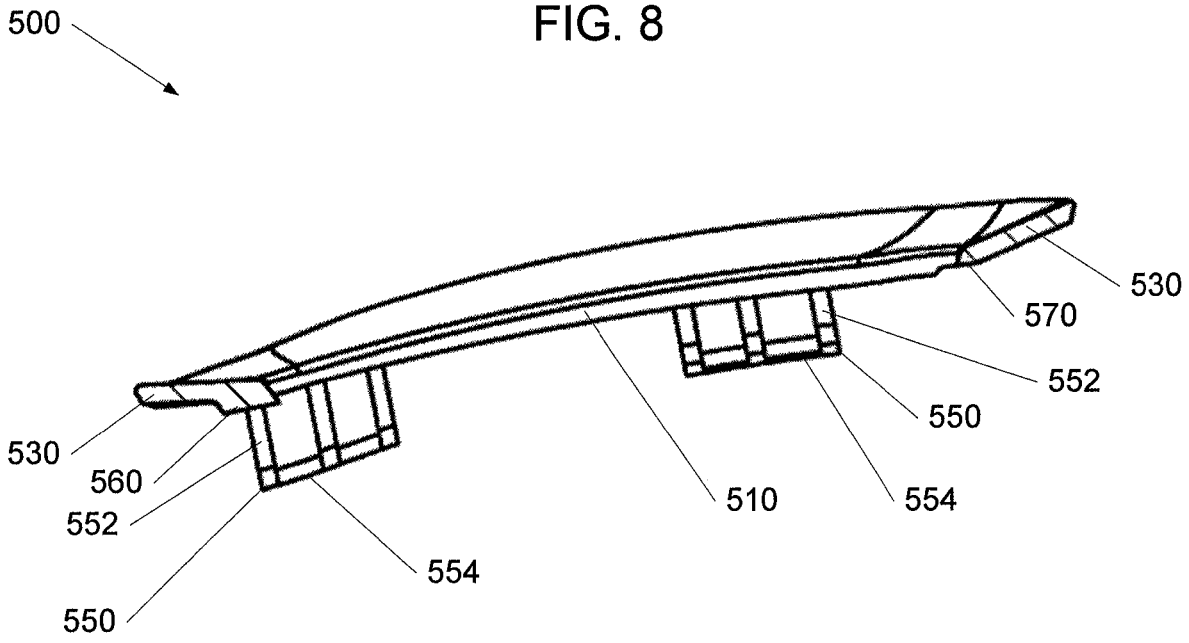
FIG. 9 is a section view of the vent adapter of FIG. 5 in accordance with an illustrative embodiment.

Referring now to FIG. 5, a front view of a vent adapter 500 in accordance with an illustrative embodiment is shown. Referring now to FIG. 6, a side view of the vent adapter 500 of FIG. 5 in accordance with an illustrative embodiment is shown. Referring now to FIG. 7, a perspective view of the vent adapter 500 of FIG. 5 in accordance with an illustrative embodiment is shown. Referring now to FIG. 8, a top view of the vent adapter 500 of FIG. 5 in accordance with an illustrative embodiment is shown. Referring now to FIG. 9, a section view of the vent adapter 500 of FIG. 5 in accordance with an illustrative embodiment is shown. The vent adapter 500 can include a vent adapter body 510. The vent adapter body 510 can be configured to correspond to a vent as discussed above.

The vent adapter body 510 can include an opening 520, a retaining flange 530 and a gripping flange 540. The retaining flange 530 can conform to an upper surface of a vent. The retaining flange 530 can prevent the vent adapter 500 from pulling through the vent. A user can use the gripping flange 540 to assist with the insertion and removal of the vent adapter 500 from a vent.

The opening 520 can substantially match a shape of a corresponding vent; however, the opening 520 can be any shape. The opening 520 can include a first clipping surface 560 and a second clipping surface 570. When a mount clip is inserted through opening 520, attachment devices of the mount clip can capture and lock against the first clipping surface 560 and a second clipping surface 570.

Attachment devices 550 can be attached to the vent adapter body 510. Each attachment devices 550 can include a living hinge portion 552 and a retention portion 554. In one embodiment, when the vent adapter 500 is inserted into a vent, the retention portions 554 push toward the center of the vent causing the living hinge portions 552 to deflect, until the vent adapter body 510 is seated and the living hinge portions 552 spring the retention portions 554 outward. When the vent adapter 500 is inserted and seated, the vent adapter 500 can be secured to the helmet between retaining flange 530 and the attachment devices 550. Alternatively, a vent adapter can be molded directly into a helmet.

Figure 10:
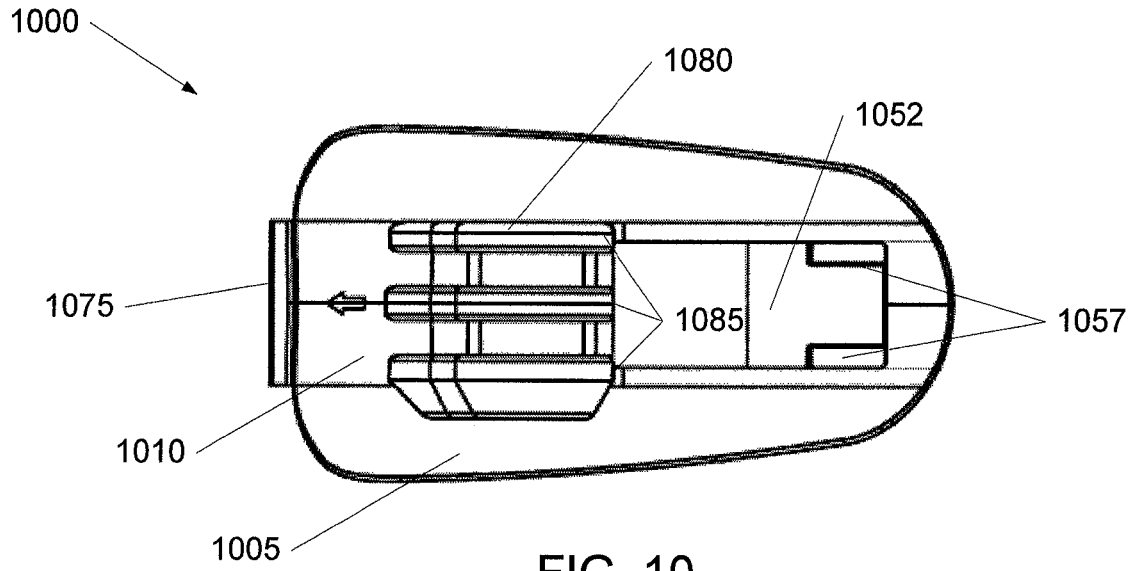
FIG. 10 is a top view of a mount body in accordance with an illustrative embodiment.
Figure 11:
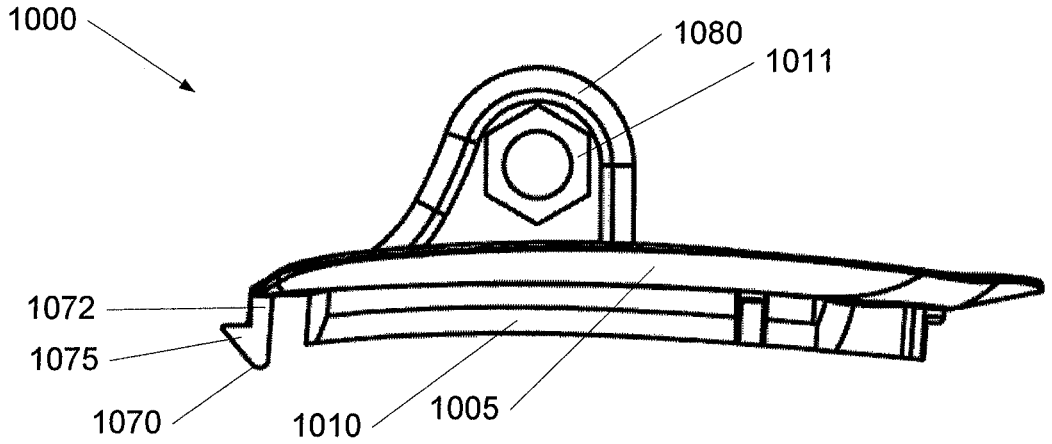
FIG. 11 is a side view of the mount body of FIG. 10 in accordance with an illustrative embodiment.
Figure 12:
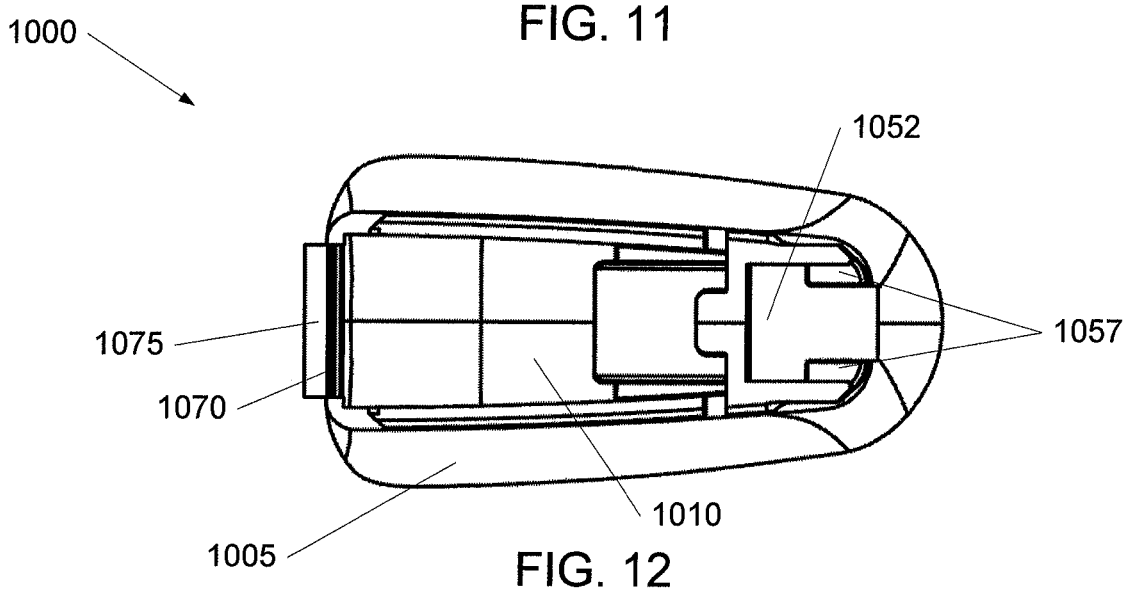
FIG. 12 is a bottom view of the mount body of FIG. 10 in accordance with an illustrative embodiment.
Figure 13:
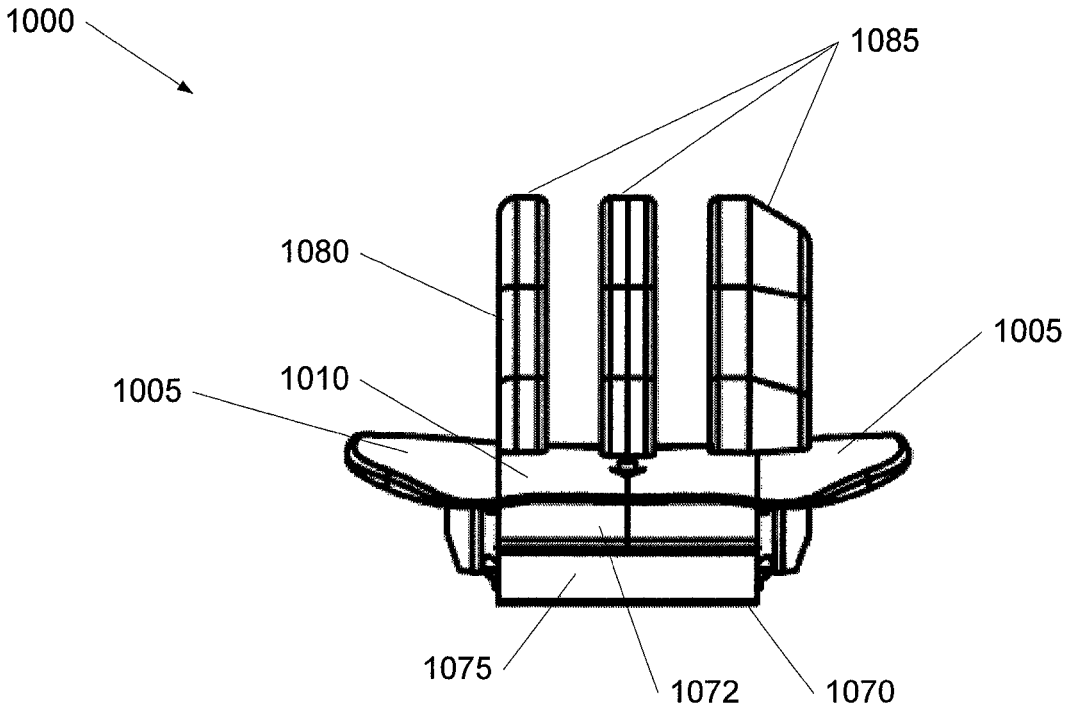
FIG. 13 is a front view of the mount body of FIG. 10 in accordance with an illustrative embodiment.
Figure 14:
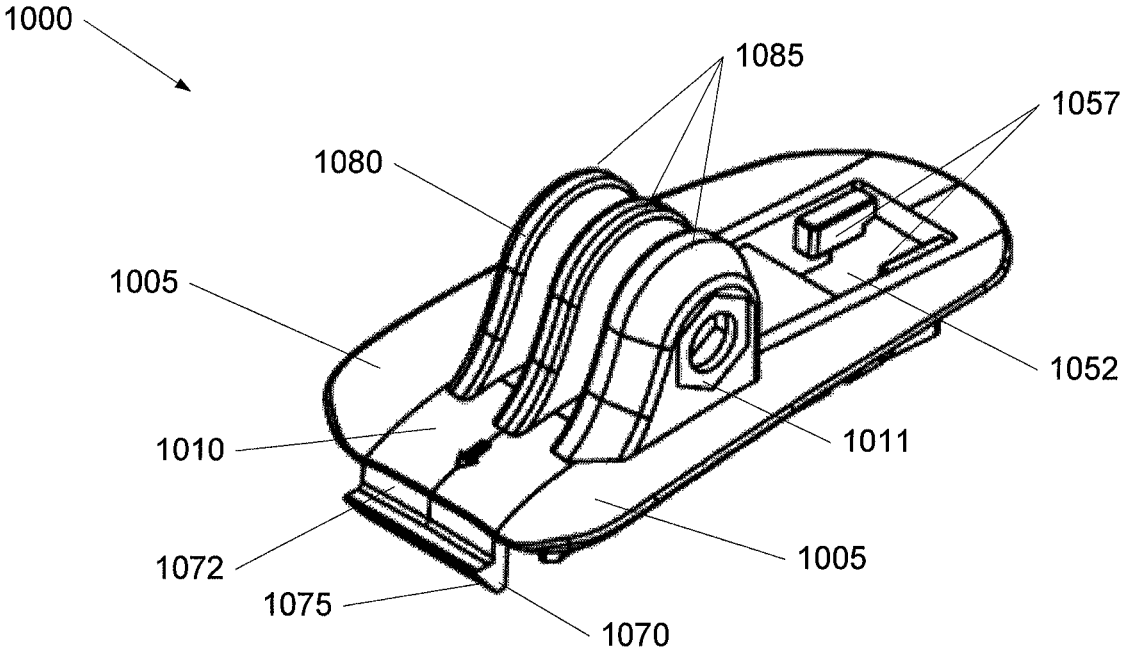
FIG. 14 is a perspective view of the mount body of FIG. 10 in accordance with an illustrative embodiment.

Referring now to FIG. 10, a top view of a mount body 1000 in accordance with an illustrative embodiment is shown. Referring now to FIG. 11, a side view of the mount body 1000 of FIG. 10 in accordance with an illustrative embodiment is shown. Referring now to FIG. 12, a bottom view of the mount body 1000 of FIG. 10 in accordance with an illustrative embodiment is shown. Referring now to FIG. 13, a front view of the mount body 1000 of FIG. 10 in accordance with an illustrative embodiment is shown. Referring now to FIG. 14, a perspective view of the mount body 1000 of FIG. 10 in accordance with an illustrative embodiment is shown. The mount body 1000 can include a base 1010. The base 1010 can include a retaining flange 1005. The base 1010 and the retaining flange 1005 can be configured to match or blend into a surrounding vent adapter and/or helmet shell. Alternatively, the base 1010 and the retaining flange 1005 can be configured to correspond to a vent as discussed above.

The base 1010 can include a mounting point 1080, a first attachment device 1070 and a sliding mount 1057 for a second attachment device (not shown). The base 1010 can include an opening 1052 for coupling the second attachment device to the sliding mount 1057. Rails of the second attachment device can be matched to the sliding mount 1057.

The mounting point 1080 can include fingers 1085. One of the fingers 1085 can include a nut recess 1011. The fingers 1085 can include openings to accept a bolt that can thread into a nut placed in the nut recess 1011. Alternatively, on or more of the fingers 1085 can include a threaded opening.

The first attachment device 1070 can include a living hinge 1072 and a wedge clip 1075. The living hinge 1072 and a wedge clip 1075 can be configured to clip into a clipping surface, for example, first clipping surface 560.

Figure 15:
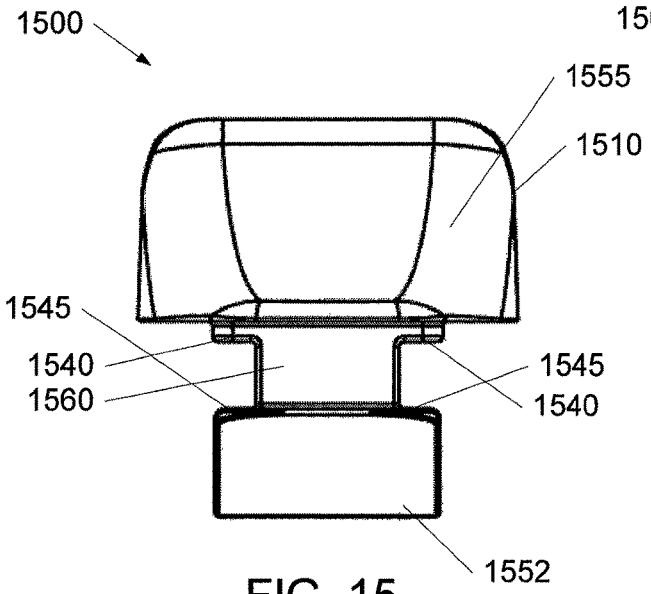
FIG. 15 is a rear view of a second attachment device in accordance with an illustrative embodiment.
Figure 16:
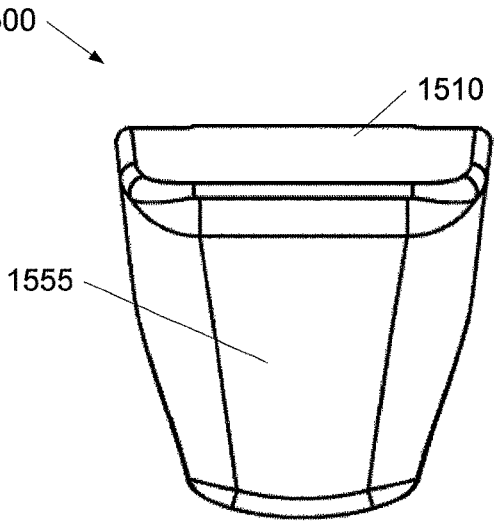
FIG. 16 is a top view of the second attachment device of FIG. 15 in accordance with an illustrative embodiment.
Figure 17:
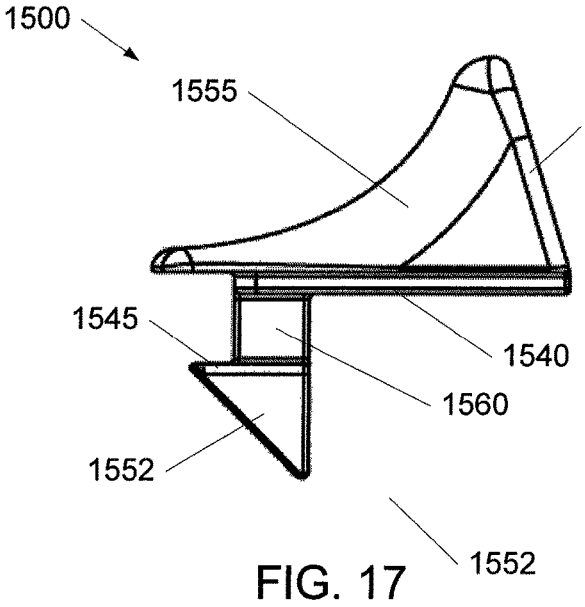
FIG. 17 is a side view of the second attachment device of FIG. 15 in accordance with an illustrative embodiment.
Figure 18:
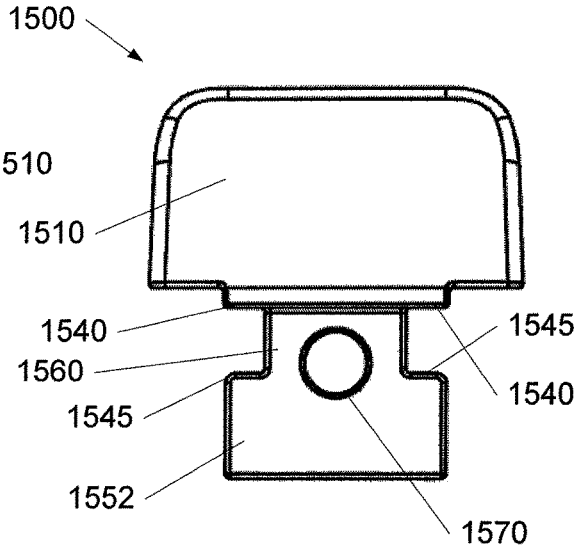
FIG. 18 is a front view of the second attachment device of FIG. 15 in accordance with an illustrative embodiment.
Figure 19:
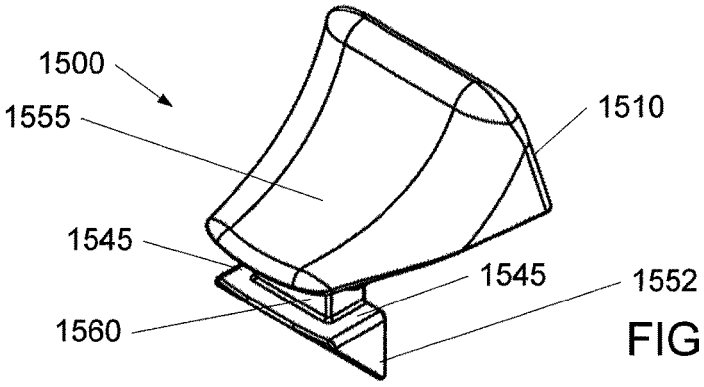
FIG. 19 is a perspective view of the second attachment device of FIG. 15 in accordance with an illustrative embodiment.

Referring now to FIG. 15, a rear view of a second attachment device 1500 in accordance with an illustrative embodiment is shown. Referring now to FIG. 16, a top view of the second attachment device 1500 of FIG. 15 in accordance with an illustrative embodiment is shown. Referring now to FIG. 17, a side view of the second attachment device 1500 of FIG. 15 in accordance with an illustrative embodiment is shown. Referring now to FIG. 18, a front view of the second attachment device 1500 of FIG. 15 in accordance with an illustrative embodiment is shown. Referring now to FIG. 19, a perspective view of the second attachment device 1500 of FIG. 15 in accordance with an illustrative embodiment is shown. The second attachment device 1500 can include a body 1510. The body 1010 can include a manipulation surface 1555, upper slide rails 1540, lower slide rails 1545, post 1560, and wedge clip 1552.

The upper slide rails 1540 and the lower slide rails 1545 can capture a slide mount of a mount body such that the second attachment device 1500 can move when the manipulation surface 1555 is pressed. The upper slide rails 1540 can be located, for example, on the bottom of the body 1010. The post 1560 can locate the wedge clip 1552. The lower slide rails 1545 can be located, for example, on the top of the wedge clip 1552. The post 1560 can include a spring seat 1570. The wedge clip 1552 can be configured to clip into a clipping surface, for example, second clipping surface 570.

Figure 20:
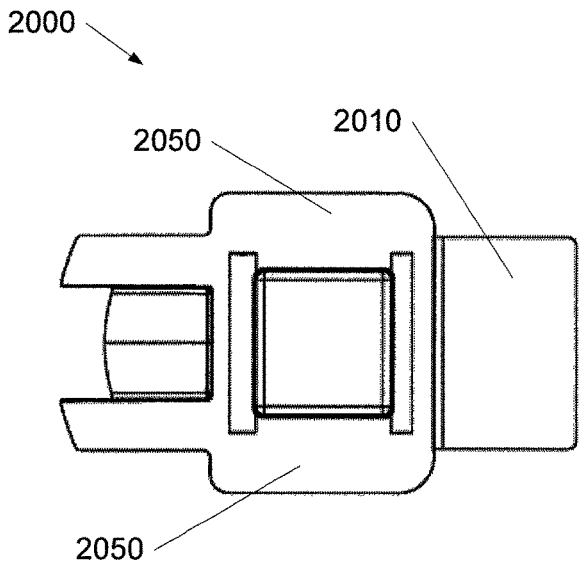
FIG. 20 is a top view of a device mount in accordance with an illustrative embodiment.
Figure 21:
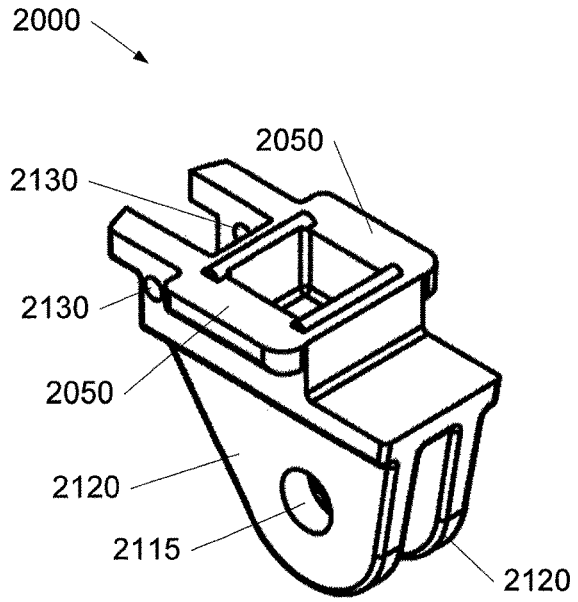
FIG. 21 is a perspective view of the device mount of FIG. 21 in accordance with an illustrative embodiment.
Figure 22:
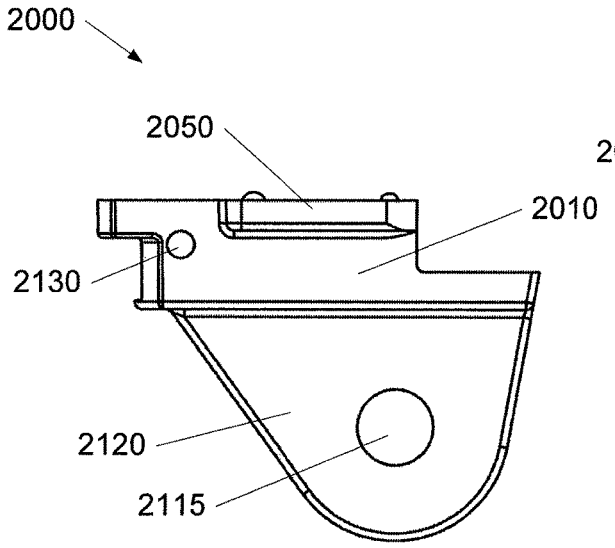
FIG. 22 is a side view of the device mount of FIG. 21 in accordance with an illustrative embodiment.
Figure 23:
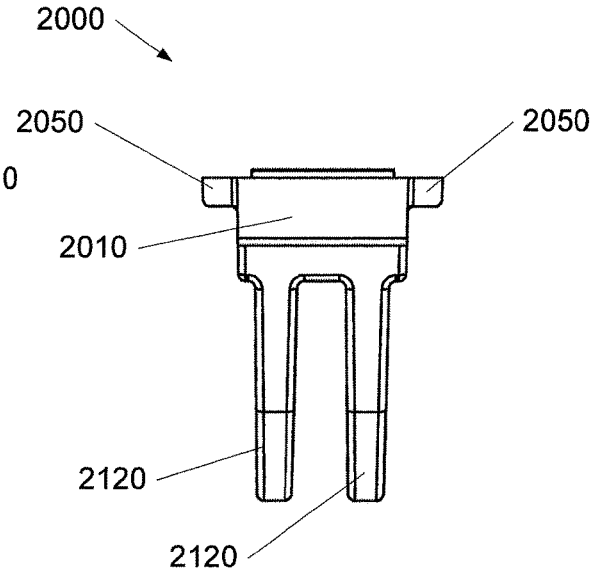
FIG. 23 is a front view of the device mount of FIG. 21 in accordance with an illustrative embodiment.

Referring now to FIG. 20, a top view of a device mount 2000 in accordance with an illustrative embodiment is shown. Referring now to FIG. 21, a perspective view of the device mount 2000 of FIG. 21 in accordance with an illustrative embodiment is shown. Referring now to FIG. 22, a side view of the device mount 2000 of FIG. 21 in accordance with an illustrative embodiment is shown. Referring now to FIG. 23, a front view of the device mount 2000 of FIG. 21 in accordance with an illustrative embodiment is shown. The device mount 2000 can be coupled to a mounting point of a mount body, for example, mounting point 1080. The device mount 2000 can be configured to hold cameras, lights, etc.

The device mount 2000 can include a body 2010, fingers 2120, mounting tabs 2050, and clip lever pivot holes 2130. The fingers 2120 can include openings 2115 to match openings in the fingers of a corresponding mounting point of a mount body, for example, mounting point 1080. The mounting tabs. 2050 can be configured to hold a device such as cameras, lights, etc. The clip lever pivot holes 2130 can be used to attach a clip lever to the body 2010.

Figure 24:
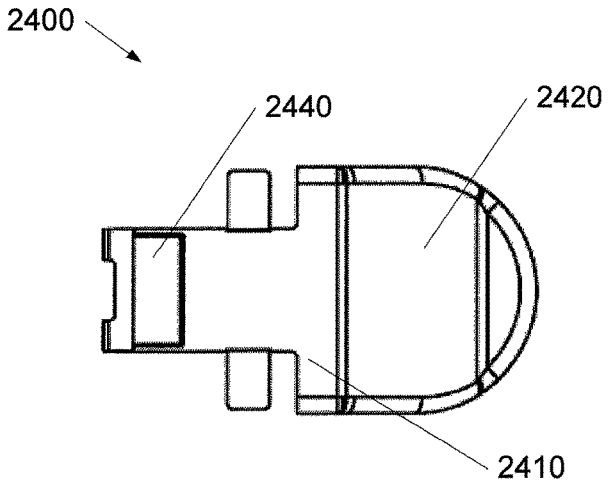
FIG. 24 is a top view of a clip lever in accordance with an illustrative embodiment
Figure 25:
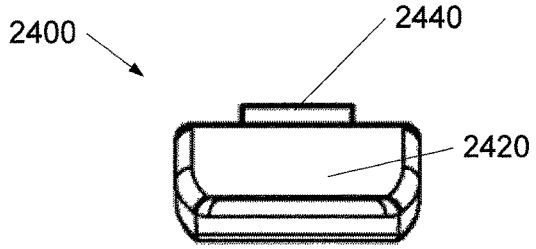
FIG. 25 is a front view of clip lever of FIG. 24 in accordance with an illustrative embodiment.
Figure 26:
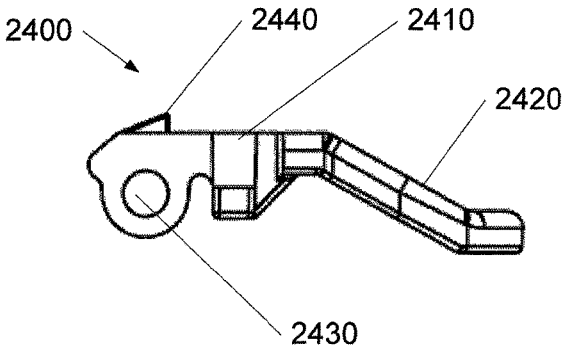
FIG. 26 is a side view of the clip lever of FIG. 24 in accordance with an illustrative embodiment.
Figure 27:
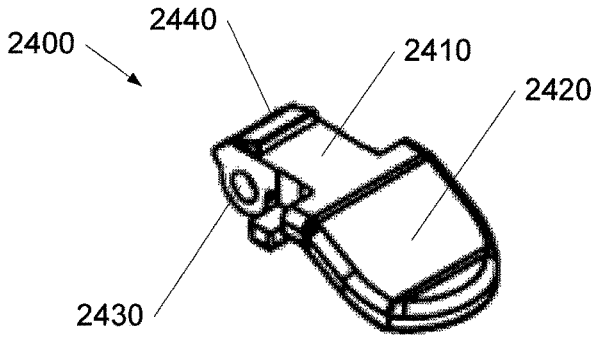
FIG. 27 is a perspective view of the clip lever of FIG. 24 in accordance with an illustrative embodiment.

Referring now to FIG. 24, a top view of a clip lever 2400 in accordance with an illustrative embodiment is shown. Referring now to FIG. 25, a front view of clip lever 2400 of FIG. 24 in accordance with an illustrative embodiment is shown. Referring now to FIG. 26, a side view of the clip lever 2400 of FIG. 24 in accordance with an illustrative embodiment is shown. Referring now to FIG. 27, a perspective view of the clip lever 2400 of FIG. 24 in accordance with an illustrative embodiment is shown. The clip lever 2400 can include a body 2410. The body 2410 can include a manipulation surface 2420, a pivot hole 2430, and a retaining wedge 2440. The clip lever 2400 can be coupled to a device mount, for example, device mount 2000, by a pin through the pivot hole 2430 an corresponding clip lever pivot holes of the device mount.

Figure 28:
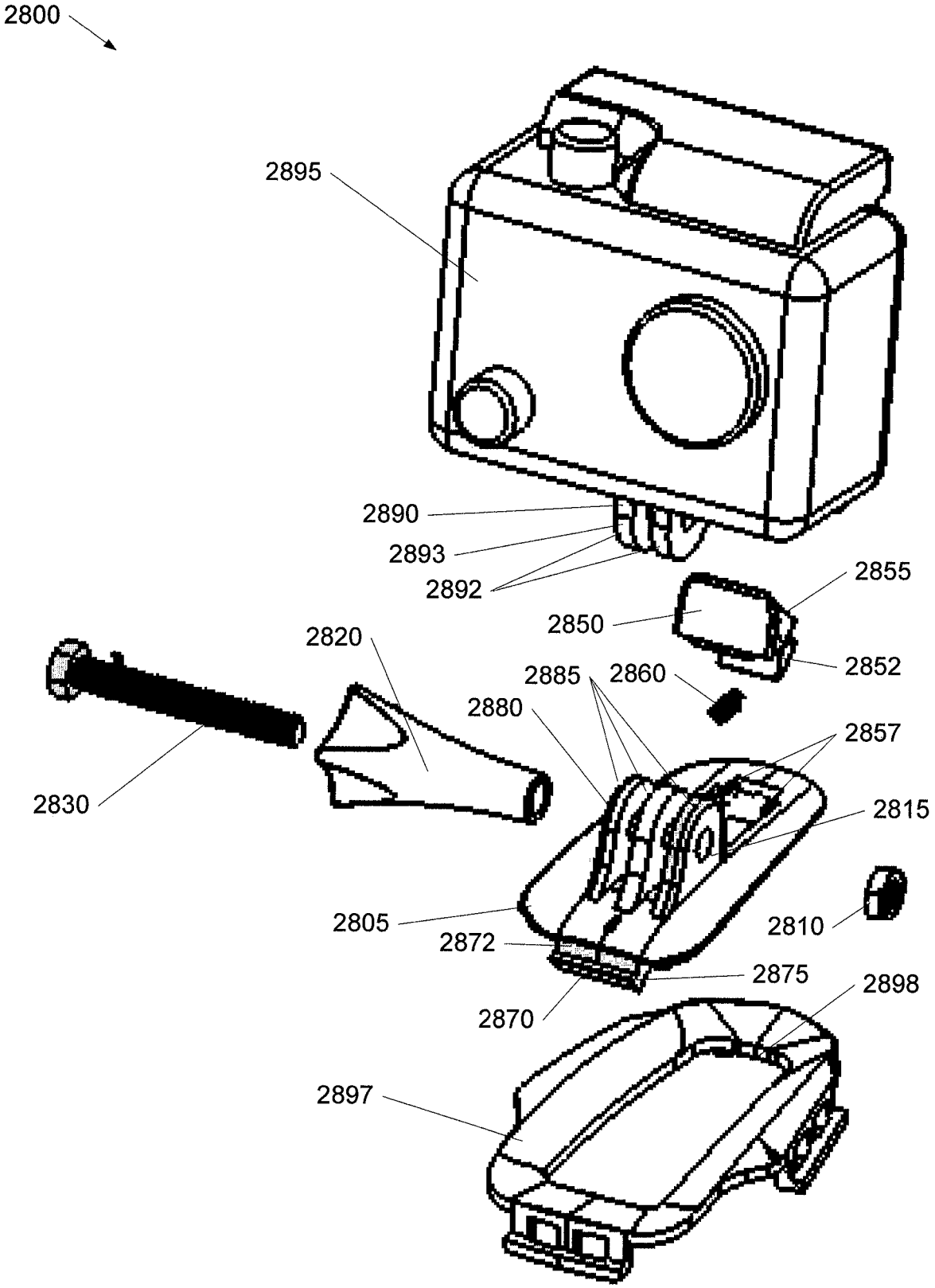
FIG. 28 is an exploded perspective view of a mount assembly in accordance with an illustrative embodiment.

Referring now to FIG. 28, an exploded perspective view of a mount assembly 2800 in accordance with an illustrative embodiment is shown. The mount clip assembly 2800 can include a mount base 2805 and a device mount 2890. The mount base 2805 can include a mounting point 2880, a first attachment device 2870 and a sliding mount 2857 for a second attachment device 2850. The mount base 2805 can be configured to match or blend into a surrounding vent adapter 2897 and/or helmet shell. The device mount 2890 can include a device mounting point 2892.

The mounting point 2880 can include fingers 2885. One of the fingers 2885 can be configured to retain a nut 2810. The fingers 2885 can include openings to accept a bolt 2830 that can thread into the nut 2810. The bolt 2830 can be manipulated using a knob 2820. When the knob 2820 is tightened, the fingers 2885 can be drawn together between the knob 2820 and the nut 2810. The device mounting point 2892 can include device fingers 2893 that mate with fingers 2885.

The first attachment device 2870 can include a living hinge 2872 and a wedge clip 2875. The second attachment device 2850 can include a wedge clip 2852. A spring 2860 can be captured between the second attachment device 2850 and the mount base 2805. The second attachment device 2850 can be attached to the sliding mount 2857 such that pressing on a manipulation surface 2855 of the second attachment device 2850 will slide the wedge clip 2852 away from and past its corresponding clipping surface 2898.

Figure 29:
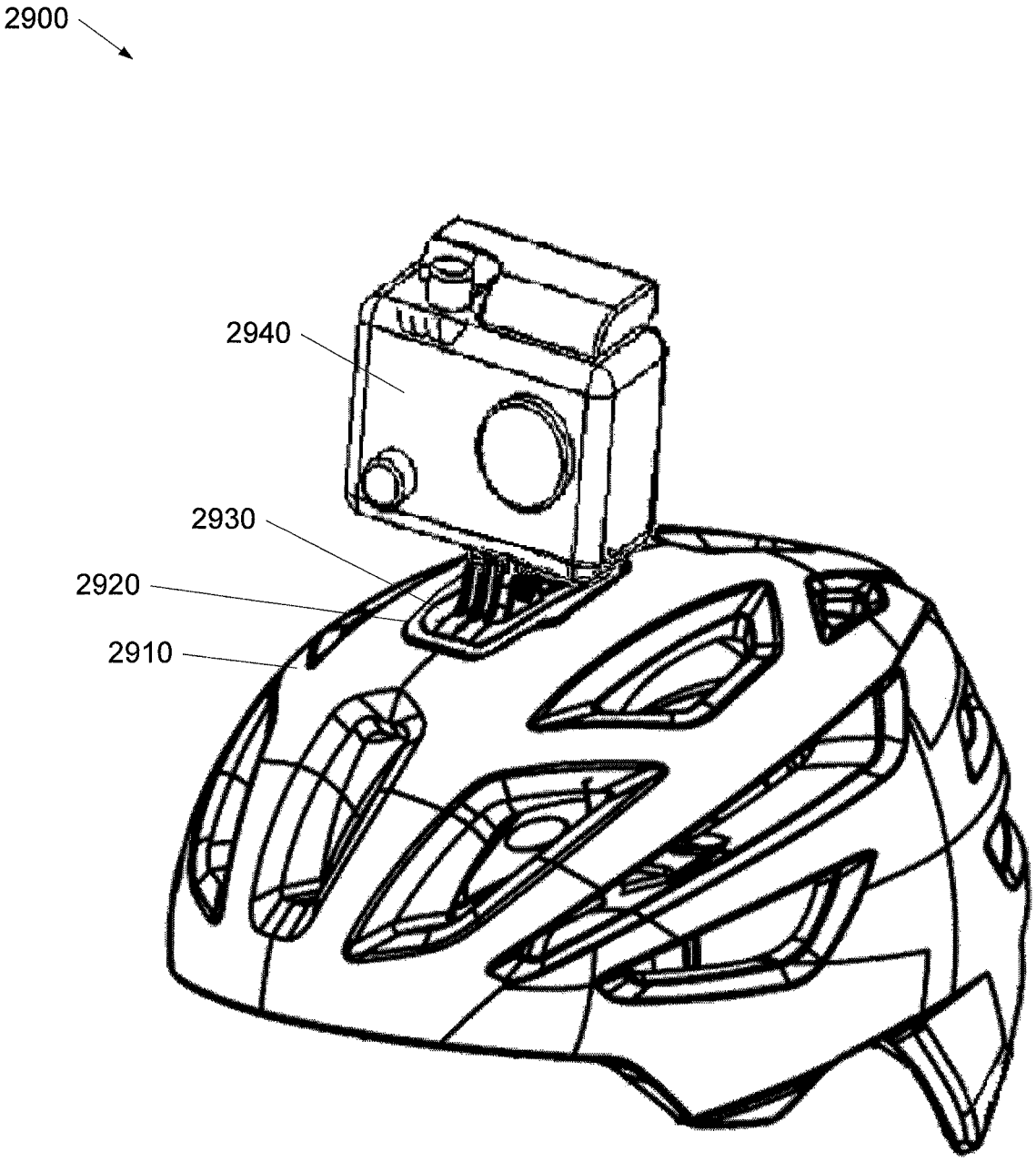
FIG. 29 is a perspective view of a helmet with camera attached in accordance with an illustrative embodiment.

Referring now to FIG. 29, a perspective view of a helmet with camera attached 2900 in accordance with an illustrative embodiment is shown. The helmet with camera attached 2900 can include a helmet 2910, a vent adapter 2920, a mounting clip with device mount 2930, and device 2940. As discussed above, the vent adapter 2920 can be clipped into the helmet 2910. As discussed above, the mounting clip with device mount 2930 can be clipped into the vent adapter 2920. As discussed above, the device 2940 can be secured to the mounting clip with device mount 2930. Advantageously, the device 2940 is securely attached to the helmet 2910.

Figure 30:
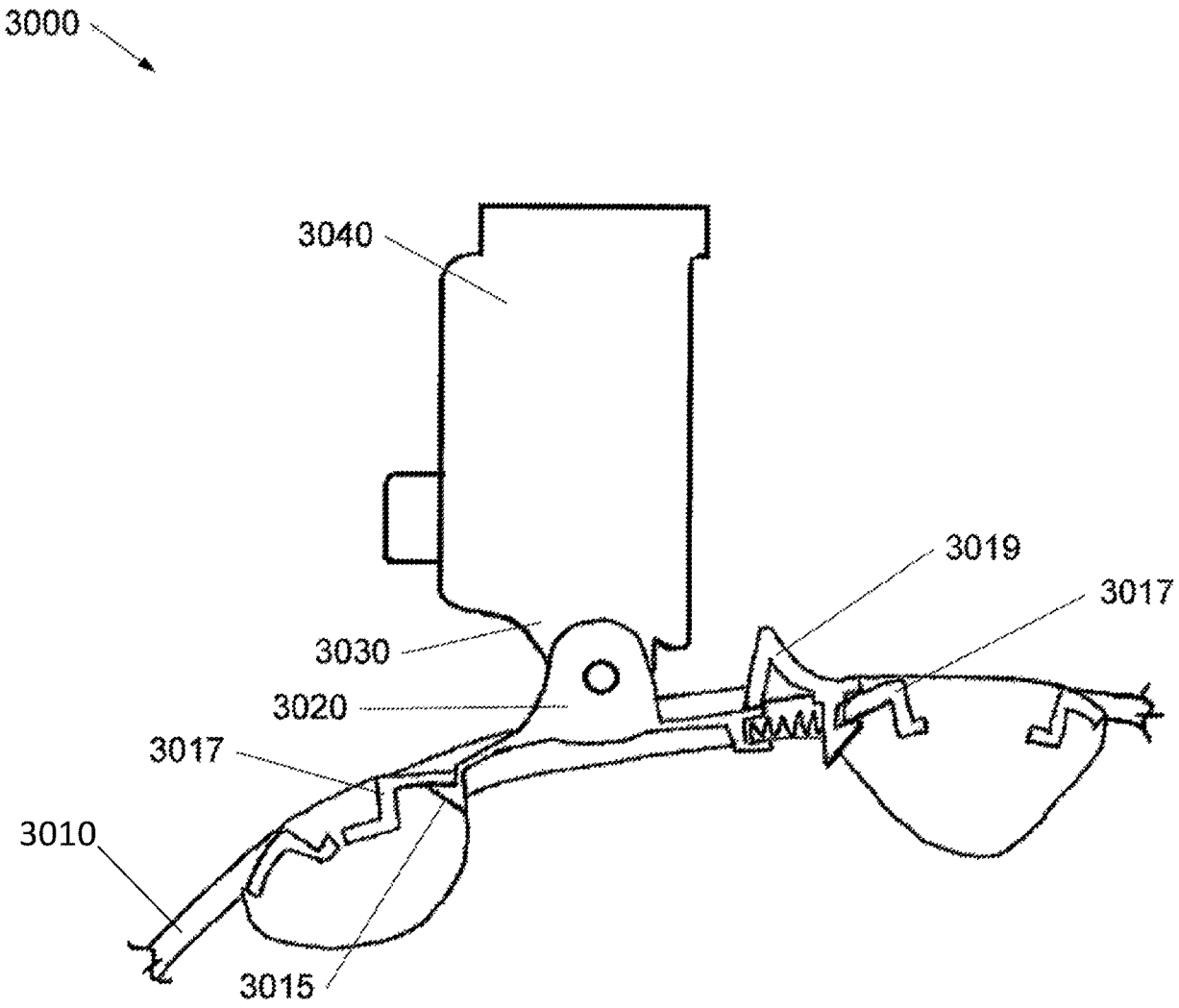
FIG. 30 is a section view of the helmet with camera attached in accordance with an illustrative embodiment.

Referring now to FIG. 30, a section view of the helmet with camera attached 3000 in accordance with an illustrative embodiment is shown. The helmet with camera attached 3000 can include a helmet 3010, a mounting clip 3020, a device mount 3030, and device 3040. As discussed above, the mounting clip 3020 can be clipped into the helmet 3010. The device mount 3030 can be coupled to the mounting clip 3020. The mounting clip 3020 can include a first attachment device 3015 that can clip into a helmet shell 3017 of the helmet 3010. The mounting clip 3020 can include a second attachment device 3019 that can clip into a helmet shell 3017 of the helmet 3010.

As discussed above, the device 3040 can be secured to the mounting clip with device mount 3030. Advantageously, the device 3040 is securely attached to the helmet 3010.

One or more flow diagrams may have been used herein. The use of flow diagrams is not meant to be limiting with respect to the order of operations performed. The herein described subject matter sometimes illustrates different components contained within, or connected with, different other components. It is to be understood that such depicted architectures are merely exemplary, and that in fact many other architectures can be implemented which achieve the same functionality. In a conceptual sense, any arrangement of components to achieve the same functionality is effectively "associated" such that the desired functionality is achieved. Hence, any two components herein combined to achieve a particular functionality can be seen as "associated with" each other such that the desired functionality is achieved, irrespective of architectures or intermedial components. Likewise, any two components so associated can also be viewed as being "operably connected", or "operably coupled", to each other to achieve the desired functionality, and any two components capable of being so associated can also be viewed as being "operably couplable", to each other to achieve the desired functionality. Specific examples of operably couplable include but are not limited to physically mateable and/or physically interacting components and/or wirelessly interactable and/or wirelessly interacting components and/or logically interacting and/or logically interactable components.

With respect to the use of substantially any plural and/or singular terms herein, those having skill in the art can translate from the plural to the singular and/or from the singular to the plural as is appropriate to the context and/or application. The various singular/plural permutations may be expressly set forth herein for sake of clarity.

It will be understood by those within the art that, in general, terms used herein, and especially in the appended claims (e.g., bodies of the appended claims) are generally intended as "open" terms (e.g., the term "including" should be interpreted as "including but not limited to," the term "having" should be interpreted as "having at least," the term "includes" should be interpreted as "includes but is not limited to," etc.). It will be further understood by those within the art that if a specific number of an introduced claim recitation is intended, such an intent will be explicitly recited in the claim, and in the absence of such recitation no such intent is present. For example, as an aid to understanding, the following appended claims may contain usage of the introductory phrases "at least one" and "one or more" to introduce claim recitations. However, the use of such phrases should not be construed to imply that the introduction of a claim recitation by the indefinite articles "a" or "an" limits any particular claim containing such introduced claim recitation to inventions containing only one such recitation, even when the same claim includes the introductory phrases "one or more" or "at least one" and indefinite articles such as "a" or "an" (e.g., "a" and/or "an" should typically be interpreted to mean "at least one" or "one or more"); the same holds true for the use of definite articles used to introduce claim recitations. In addition, even if a specific number of an introduced claim recitation is explicitly recited, those skilled in the art will recognize that such recitation should typically be interpreted to mean at least the recited number (e.g., the bare recitation of "two recitations,"

without other modifiers, typically means at least two recitations, or two or more recitations). Furthermore, in those instances where a convention analogous to "at least one of A, B, and C, etc." is used, in general such a construction is intended in the sense one having skill in the art would understand the convention (e.g., "a system having at least one of A, B, and C" would include but not be limited to systems that have A alone, B alone, C alone, A and B together, A and C together, B and C together, and/or A, B, and C together, etc.). In those instances where a convention analogous to "at least one of A, B, or C, etc." is used, in general such a construction is intended in the sense one having skill in the art would understand the convention (e.g., "a system having at least one of A, B, or C" would include but not be limited to systems that have A alone, B alone, C alone, A and B together, A and C together, B and C together, and/or A, B, and C together, etc.). It will be further understood by those within the art that virtually any disjunctive word and/or phrase presenting two or more alternative terms, whether in the description, claims, or drawings, should be understood to contemplate the possibilities of including one of the terms, either of the terms, or both terms. For example, the phrase "A or B" will be understood to include the possibilities of "A" or "B" or "A and B."

The foregoing description of illustrative embodiments has been presented for purposes of illustration and of description. It is not intended to be exhaustive or limiting with respect to the precise form disclosed, and modifications and variations are possible in light of the above teachings or may be acquired from practice of the disclosed embodiments. It is intended that the scope of the invention be defined by the claims appended hereto and their equivalents.

What is claimed is:

1. An apparatus, comprising: a helmet including at least one vent; a vent adapter configured to secure into the at least one vent from an outside of the helmet, wherein the vent adapter includes a first attachment surface and a second attachment surface; and a mount configured to removably secure into the vent adapter from the outside of the helmet such that at least a portion of the mount extends into the at least one vent; wherein: the mount includes a first attachment portion configured to mate with the first attachment surface; and the mount includes a second attachment portion configured to mate with the second attachment surface, wherein the second attachment portion is slidably coupled to the mount such that the second attachment portion slides independent of the first attachment portion, wherein the second attachment portion is a wedge clip that is slidably coupled to the mount.

2. The apparatus of claim 1, wherein the second attachment portion is spring loaded.

3. The apparatus of claim 1, wherein the vent adapter comprises an opening located in a center of the vent adapter.

4. The apparatus of claim 3, wherein the opening is configured to provide ventilation to the helmet.

5. The apparatus of claim 1, wherein the vent adapter comprises a vent adapter body and at least two retention portions.

6. The apparatus of claim 5, wherein the vent adapter body is contoured to match an area surrounding the at least one vent.

7. The apparatus of claim 5, wherein the at least two retention portions are configured to clip into a helmet shell of the helmet.

8. The apparatus of claim 5, wherein the at least two retention portions are configured to clip into the helmet.

9. The apparatus of claim 1, wherein the mount is configured to carry an accessory.

10. The apparatus of claim 9, wherein the mount is configured to change the direction of the accessory.

11. An apparatus, comprising: a helmet including at least one vent, wherein the at least one vent includes a vent surface defining an opening of the at least one vent, the vent surface including a first attachment surface and a second attachment surface; and a mount configured to removably secure into the at least one vent from an outside of the helmet such that at least a portion of the mount extends into the at least one vent; wherein: the mount includes a first attachment portion configured to mate with the first attachment surface; and the mount includes a second attachment portion configured to mate with the second attachment surface, wherein the second attachment portion is slidably coupled to the mount such that the second attachment portion slides independent of the first attachment portion, wherein the second attachment portion is a wedge clip that is slidably coupled to the mount.

12. The apparatus of claim 11, wherein the second attachment portion is spring loaded.

13. The apparatus of claim 11, wherein the opening is located in a center of the at least one vent.

14. The apparatus of claim 13, wherein the opening is configured to provide ventilation to the helmet.

15. The apparatus of claim 13, wherein the mount is contoured to match the opening of the at least one vent.

16. The apparatus of claim 13, wherein the mount is configured to carry an accessory.

17. The apparatus of claim 16, wherein the mount is configured to change the direction of the accessory.

18. The apparatus of claim 16, wherein the mount is configured to break free from the helmet when the accessory attached to the mount is subjected to a predetermined force.

* * * * *